US005329294A

United States Patent [19]

Ontawar et al.

[11] Patent Number: 5,329,294

[45] Date of Patent: Jul. 12, 1994

[54] USER REFILLABLE INK JET CARTRIDGE AND METHOD FOR MAKING SAID CARTRIDGE

[75] Inventors: Susan P. Ontawar, Vernon; Fred Keen, Tenafly, both of N.J.

[73] Assignee: Repeat-O-Type Mfg. Co., Inc., Wayne, N.J.

[21] Appl. No.: 975,388

[22] Filed: Nov. 12, 1992

Related U.S. Application Data

[63] Continuation-in-part of Ser. No. 950,782, Sep. 24, 1992, abandoned.

[51] Int. Cl.[5] ..... B41J 2/175

[52] U.S. Cl. ..... 397/87

[58] Field of Search ..... 346/140 R, 111, 146; 400/126; 41/1, 2, 18, 98

[56] References Cited

U.S. PATENT DOCUMENTS 4,967,207 10/1990 Ruder ..... 346/140 R
5,039,999 8/1991 Winslow et al. ..... 346/140 R
5,040,001 8/1991 Dunn et al. ..... 346/140 R
5,199,470 4/1993 Goldman ..... 141/1

*Primary Examiner*—Benjamin R. Fuller
*Assistant Examiner*—N. Le
*Attorney, Agent, or Firm*—W. Patrick Quast

[57] ABSTRACT

A non-refillable ink jet cartridge is rendered user refillable in a convenient manner. Hewlett-Packard ink jet cartridge #51626A is modified by sealing the vent hole at the base of the cartridge with a pressure sensitive adhesive tape, and removing the air tight ink fill plug at the top of the cartridge. After refilling with ink, a bellows type inflator bottle is used to inflate bladders within the cartridge making use of an opening in the cartridge. The ink fill opening is re-sealed either immediately before or just after the bladders are inflated, and bile inflator bobble is then removed which releases the air pressure in the bladders causing the bladders to deflate. The deflated bladders cause an area of reduced air pressure to develop over the ink fill level, which prevents the ink from leaking out of the cartridge when the pressure sensitive adhesive tape covering the vent hole at the base of the cartridge is removed.

24 Claims, 7 Drawing Sheets

USER REFILLABLE INK JET CARTRIDGE AND METHOD FOR MAKING SAID CARTRIDGE

BACKGROUND OF THE INVENTION

This application is a continuation in part of copending application Ser. No. 07/950,782, filed Sep. 24, 1992, now abandoned.

This invention relates to ink jet cartridges, and in particular to user refillable ink jet cartridges.

The use of convenient single color (e.g. black) ink jet cartridges for use in printing computer generated documents and other printing devices is today standard practice. For example, Hewlett-Packard Company (300 Hanover, P.O. Box #10301, Palo Alto, Calif. 94303-0890, U.S.A.) has been marketing ink jet cartridge #51608A for use in Hewlett-Packard Desk Jet, Deskwriter and similar printers. This cartridge has been supplied from Hewlett-Packard as a non-refillable, disposable ink jet cartridge. However, for several years it has been known that these cartridges can be rendered user refillable by inserting an ink filled hypodermic needle into an air vent in the cartridge top, and injection of enough fresh ink into the cartridge to saturate the foam sponge inside the cartridge.

Recently Hewlett-Packard introduced a higher capacity non-refillable and disposable ink jet cartridge #51626A for use in the same printing devices noted above. The increased ink capacity of the new cartridge was accomplished by sealing the air vent hole with an air tight press fit plastic plug, which is to be found at one of the four corners of the top surface of the cartridge. At the same time a set of inflatable air bladders, which do not allow direct access to the ink reservoir, have been placed within the ink jet cartridge. A hole at the top center of the cartridge provides a direct connection with the inflatable air bladders within the cartridge. Thus the new cartridge #51626A incorporates the principal of reduced air pressure in the closed chamber above the liquid ink level to prevent the ink from dripping out of the minute orifices at the bottom of the cartridge.

While these newer cartridges provide the advantage of a greater ink supply, it would still be a significant advantage to the user to be able to refill the cartridge ink supply repeatedly, thereby greatly extending the use Of the cartridge, and lowering the cost of each copy produced by the cartridge. The instant invention provides a solution to this problem by disclosing a method for converting a non-refillable ink jet cartridge into a user refillable ink jet cartridge, thereby providing said refillable cartridge to users of this equipment.

SUMMARY OF THE INVENTION

Accordingly, it is a primary object of the invention to provide a refillable ink jet dispensing system.

Another object is to provide a refillable ink jet dispensing system utilizing a single ink color.

Still another object is to provide an economical ink Jet dispensing system.

A further object is to permit printing a maximum number of copies with an ink jet dispensing system.

An additional object of the invention is to provide the user with means for refilling the ink supply in an ink depleted ink jet dispensing system.

The above recited and other objects are obtained in the instant invention. It has been discovered that the Hewlett-Packard cartridge #51626A can be converted into a user refillable ink jet cartridge in a convenient manner. Initially it was determined that the air tight plug at the top of this cartridge could be removed by pushing it into the cartridge. This can be accomplished in a variety of ways such as, for example, by pushing a small diameter nail into the plug. However, a preferred embodiment of the invention makes use of a cylindrically shaped rod, slightly smaller in diameter than the air tight plug, to push the plug into the interior of the cartridge. With this plug removed fresh ink can now be added through this hole created by the removal of the plug to replenish the cartridge ink supply. Commercially available refill ink bottles, together with their commercially available filler tubes are employed to refill the cartridge.

After refilling cartridge #51626A with ink the hole at its top created by the removal of the air tight plug is resealed. Many methods can be used to reseal this hole such as putting in a new plug, etc. A preferred method is to place a pressure sensitive adhesive tape over this opening. Even doing this, however, does not prevent leakage from the print orifices and small vent hole at the cartridge bottom for a considerable period of time. This leakage can be prevented by: inserting a soft rubber plug into the hole at the top of a just refilled #51626A cartridge, and, with a small gauge hypodermic needle inserted through this rubber plug to depth above the liquid level, sucking some of the air out of the cartridge, creating a partial vacuum.

Finally the following preferred method for rendering a Hewlett-Packard cartridge #51626A refillable, and refilling said cartridge was developed:

A. The cartridge is placed in a jig, and pressure sensitive tape is placed over the vent hole at the base of the cartridge. [Note: The jig can consist of a variety of simple holding devices such as a small stand, a hollow clear plastic holder, etc.]

B. A cylindrically shaped rod is used to push into the cartridge the air tight plug at the top of the cartridge.

C. A commercially available ink bottle and filler tube is used to replenish the ink supply through the opening created by removal of said air tight plug.

D. A bellows type inflator bottle is employed to create the reduced air pressure in the closed chamber above the liquid ink level. The inflator bottle (available from "Repeat-O-Type Corporation, 665 State H'way No.23, Wayne, N.J. 07470") consists of an empty plastic squeeze bottle. The open end of the inflator bottle is placed over the opening at the top of the ink jet cartridge that connects with the inflatable bladders within the cartridge. The top of the inflator bottle is pressed securely against this opening whereupon squeezing the inflator bottle between your fingers causes the inflatable bladders to be inflated with air. The above procedure for inflating the bladders within the cartridge may be done with the opening at the top of the cartridge created by the removal of the air tight plug remaining open, followed by sealing this opening closed after inflating the bladders by placing pressure sensitive adhesive tape over this opening. Alternatively, a more convenient and effective method is to seal this opening closed with said pressure sensitive adhesive tape after the cartridge is re-filled with ink, and before the bladders within the cartridge are inflated.

E. Finger pressure is now released from the inflator bottle, which causes reduced air pressure to develop over the ink level within the cartridge, preventing the ink from dripping out of the vent hole at the base of the cartridge.

F. The few drops of ink that may drip out during this refilling process can be absorbed by placing an absorbent pad, such as a cotton pad, at the base of the jig beneath the cartridge.

G. The pressure sensitive adhesive tape covering the vent hole at the base of the cartridge is now removed, and the cartridge can now be reinstalled in the printer.

DETAILED DESCRIPTION OF THE PREFERRED EMBODIMENTS

Figure 1:
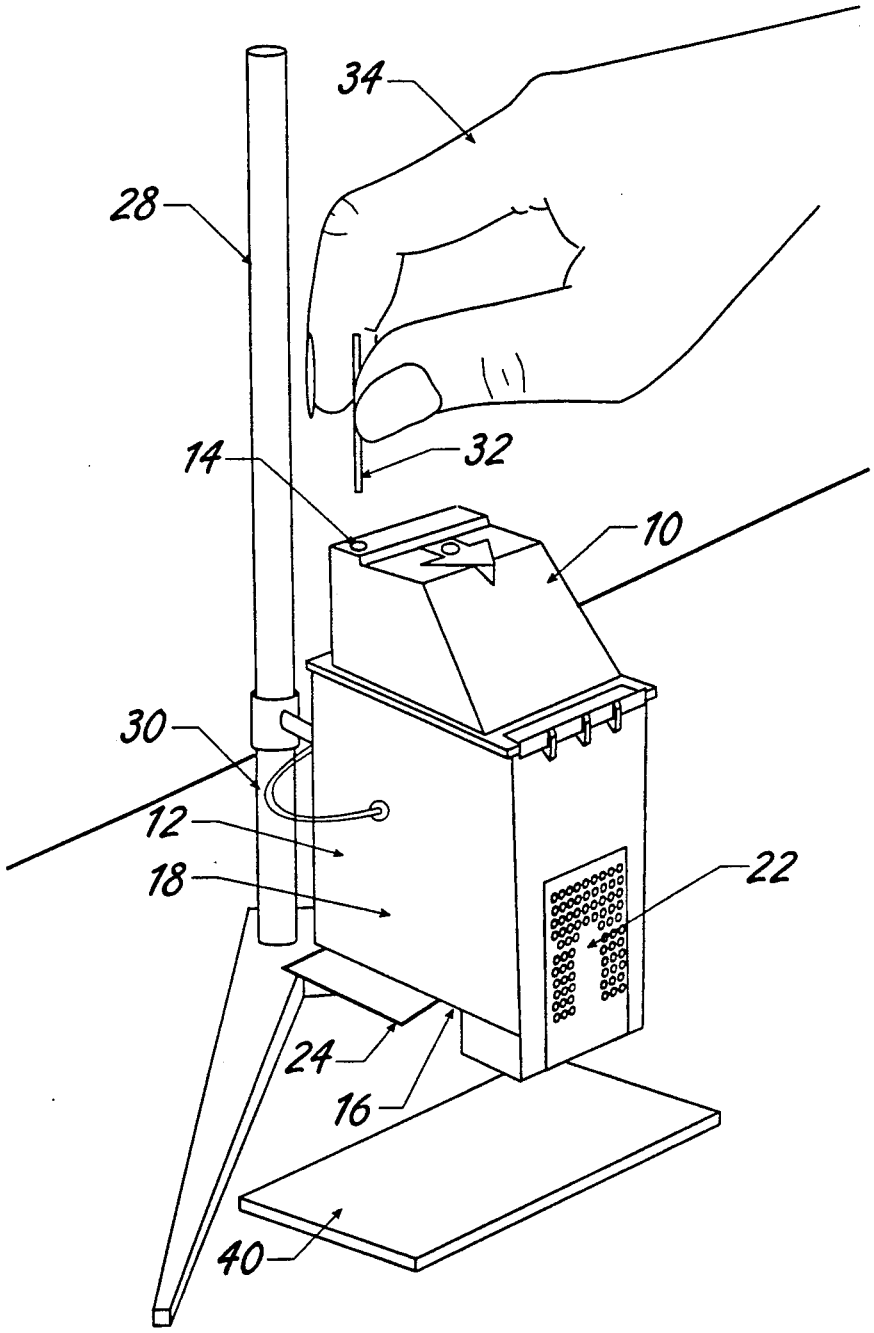
FIG. 1 is a perspective view of a non-refillable ink jet cartridge about to be modified by the method of the invention into a refillable cartridge.

FIG. 1 shows cartridge 10 connected to jig 28 by means of spring loaded clamp 30 which is connected to jig. 28. Cartridge 10 is Hewlett-Packard ink jet cartridge #51626A. Cartridge 10 is supplied by the manufacturer with an air tight plug 14 sealing opening 20 (FIG. 2), thereby rendering the cartridge non-refillable. Cartridge 10 has an upper portion 12 which contains the main ink supply in reservoir 18, and a lower portion 16 with ink dispensing orifices/printed circuit board 22, and a vent hole 42 (FIG. 7) forming part of what applicant believes is a pressure equalizing valve. An absorbent pad 40, as, for example, an absorbent cotton pad, is placed beneath cartridge 10 at the base of jig 28 in order to absorb the few drops of ink that may leak out of the cartridge during the ink refilling process.

Hand 34 (FIG. 1) is shown grasping cylindrical rod 32 while poised over plug 14. Cylindrical rod 32 has a slightly smaller diameter than does plug 14, and it is used to push plug 14 into the upper portion of 12 of the cartridge, thereby creating ink refill opening 20 (FIG. 2) at the top of upper portion 12. Rod 32 is preferably fabricated in metal, but can also be made out of a hard plastic, etc. Other objects can be used to dislodge plug 14, including a nail with an appropriate smaller diameter, etc. Pressure sensitive adhesive tape 24 is shown already in place, secured over vent hole 42 at the base of lower portion 16.

Figure 2:
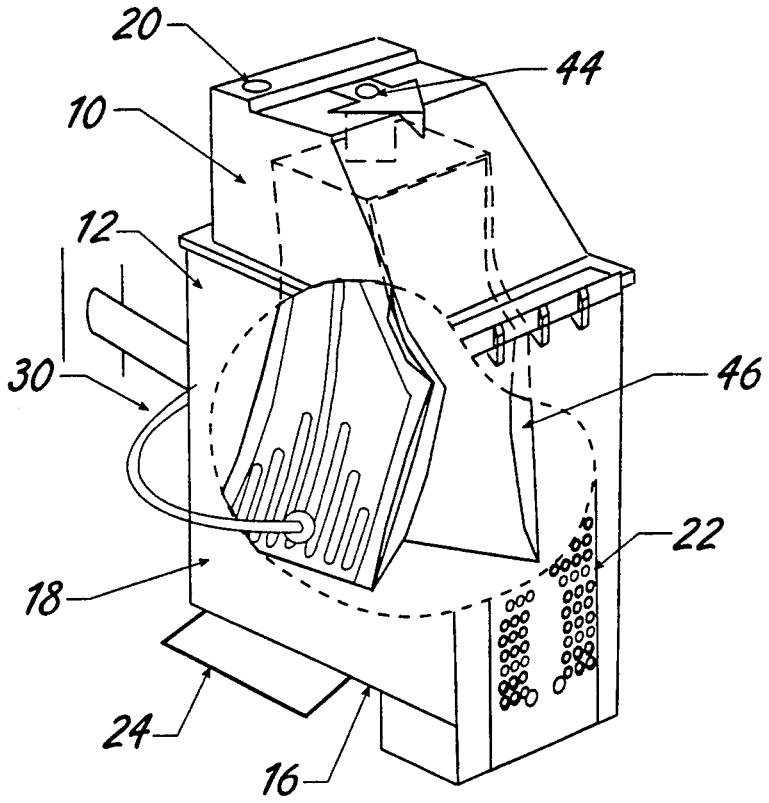
FIG. 2 is a perspective view of a modified refillable ink jet cartridge, illustrating the removal of the air tight plug, with a side wall of the cartridge cut away to show the ink reservoir interior, and the inflatable bladders.

FIG. 2 illustrates cartridge 10 now converted into a refillable ink jet cartridge with the vent hole 42 in the base of the lower portion 16 sealed closed by means of pressure sensitive adhesive tape 24, and air plug 14 removed, making opening 20 accessible for use as an ink refill opening. A portion of cartridge 10 upper portion 12 is shown cut away illustrating the placement of inflatable bladders 46 within the ink reservoir 18, with inflatable bladder opening 44 shown centrally located at the top of cartridge 10.

Figure 3:
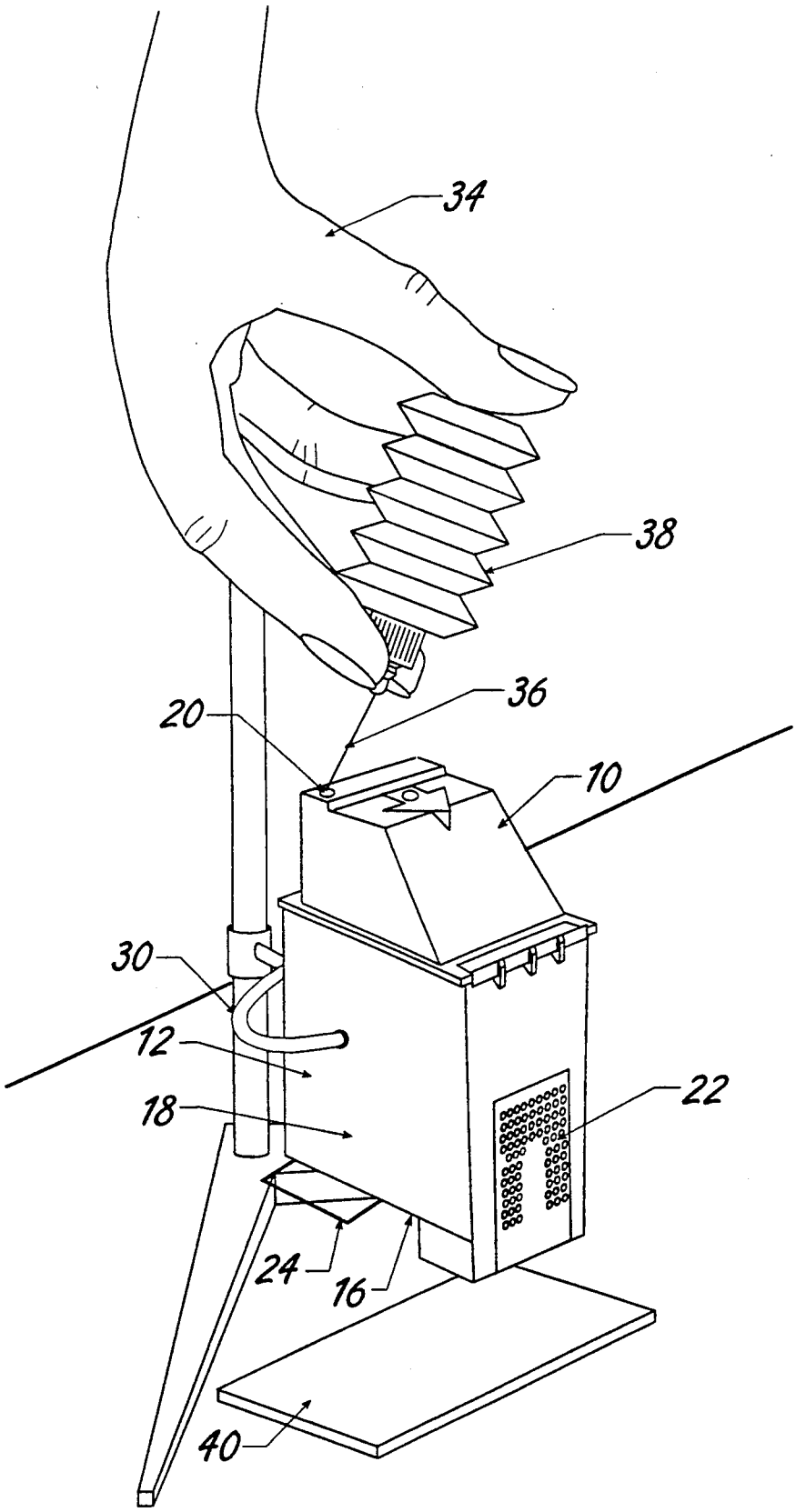
FIG. 3 illustrates a preferred procedure for refilling the ink jet cartridge of the invention.

In FIG. 3 the preferred method for replenishing ink is shown. A bottle 38 (preferably a squeeze bottle) containing an appropriate ink is shown squeezed by hand 34 to cause ink to flow through filler tube 36, and then through opening 20 to reservoir 18 cartridge upper portion 12. Appropriate inks, ink bottles, and their filler tubes are commercially available and well known to the art.

Figure 4:
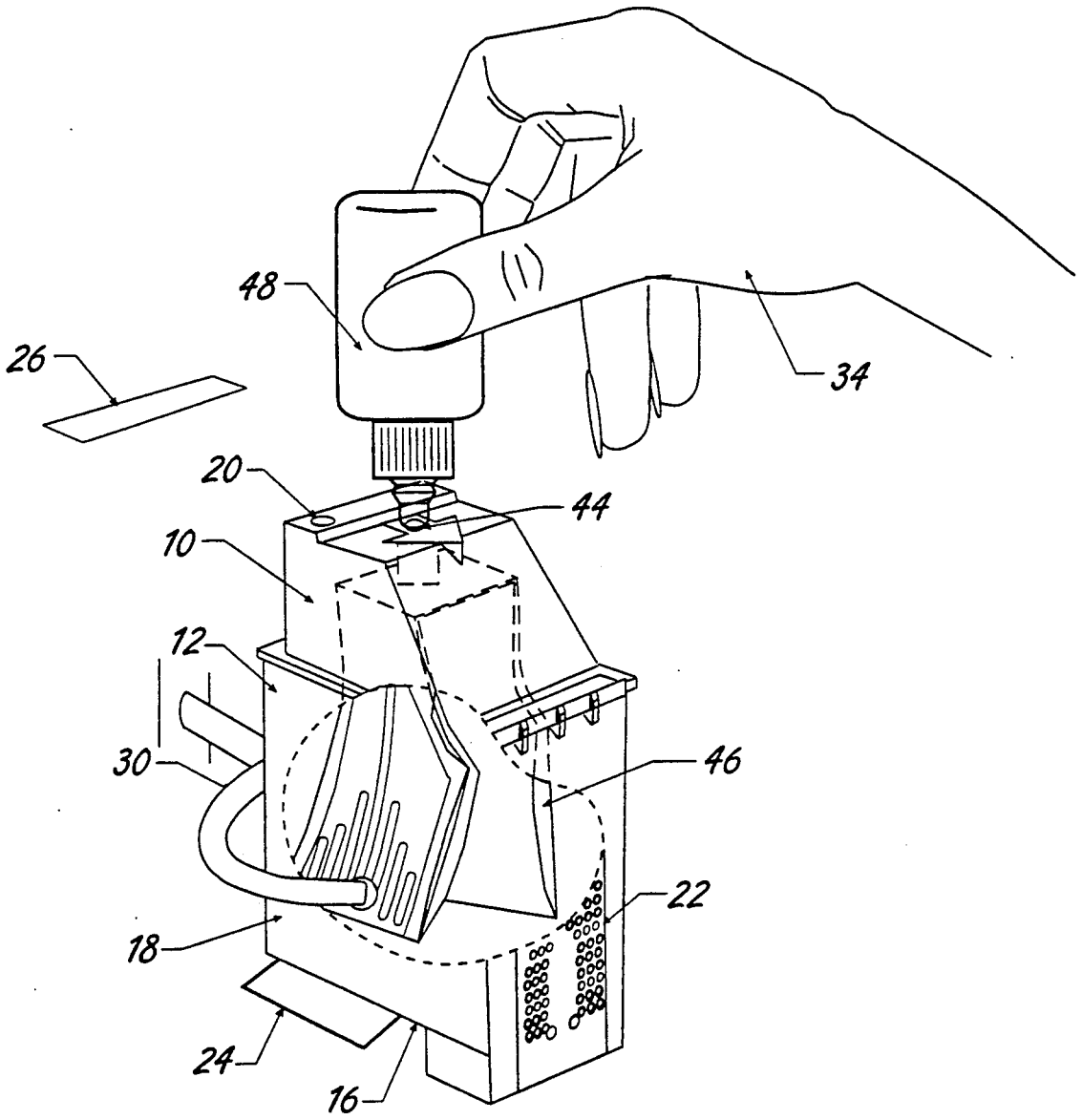
FIG. 4 illustrates a preferred procedure for inflating the inflatable bladders, and for sealing the ink refill opening with sealing tape.

Referring now to FIG. 4, once the ink supply has been replenished in reservoir 18, pressure sensitive adhesive tape 26 is placed over opening 20 in order to re-seal said opening. Other methods for sealing this opening include placing a replacement plug into hole 20, etc. The neck of bellows type inflator bottle 48 is now inserted into opening 44 (FIG. 2), and the bottle is squeezed by the fingers of hand 34, causing inflatable bladders 46 to inflate. An inflator type bottle is available from "Repeat-O-Type Corporation, 665 State H'Way No. 23, Wayne, N.J. 07470", and, of course, the bladders may be inflated with a variety of other types of bellows devices, or by blowing the bladders up by mouth using a rubber tube, or with compressed air, etc. The action of inflating time bladders after the opening 20 is sealed creates an increased pressure in the cartridge, which in turn forces the ink to drip rapidly from the ink dispensing orifices/printed circuit board 22. After several second the pressure is released by removing the inflator bottle 48 from opening 44. As the bladders 46 deflate they cause a reduced air pressure to develop above the liquid ink level within the upper portion 12 of cartridge 10, which prevents the ink from dripping out of the minute orifices at the bottom of the cartridge.

Figure 5:
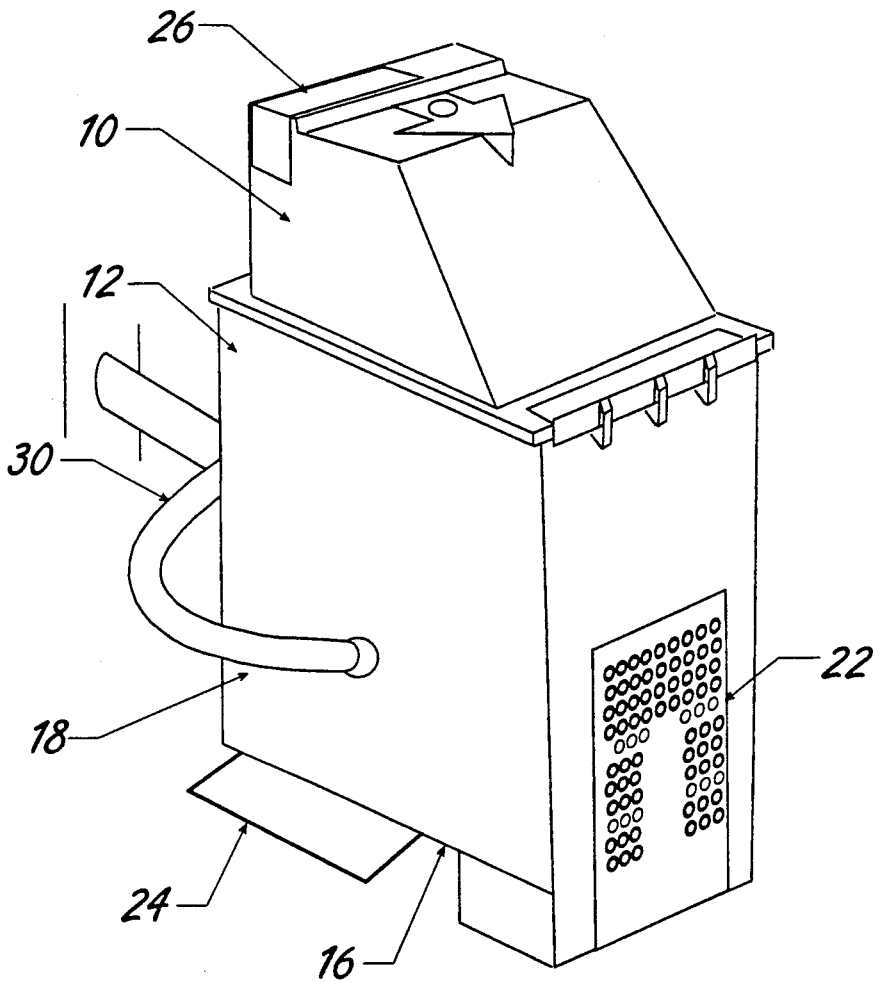
FIG. 5 illustrates the cartridge with the sealing tape in place at the ink refill hole, and at the base of the cartridge.

In an alternate method opening 20 in cartridge 10 can be left open while the bladders within the cartridge are being inflated. Pressure sensitive adhesive tape is then used to seal opening 20 closed, and the bladders are then deflated. FIG. 5 illustrates cartridge 10 with sealing tape 26 in place on the ink re-fill opening 20, and sealing tape 24 is shown sealing opening 42 at the base of the cartridge.

Figure 6:
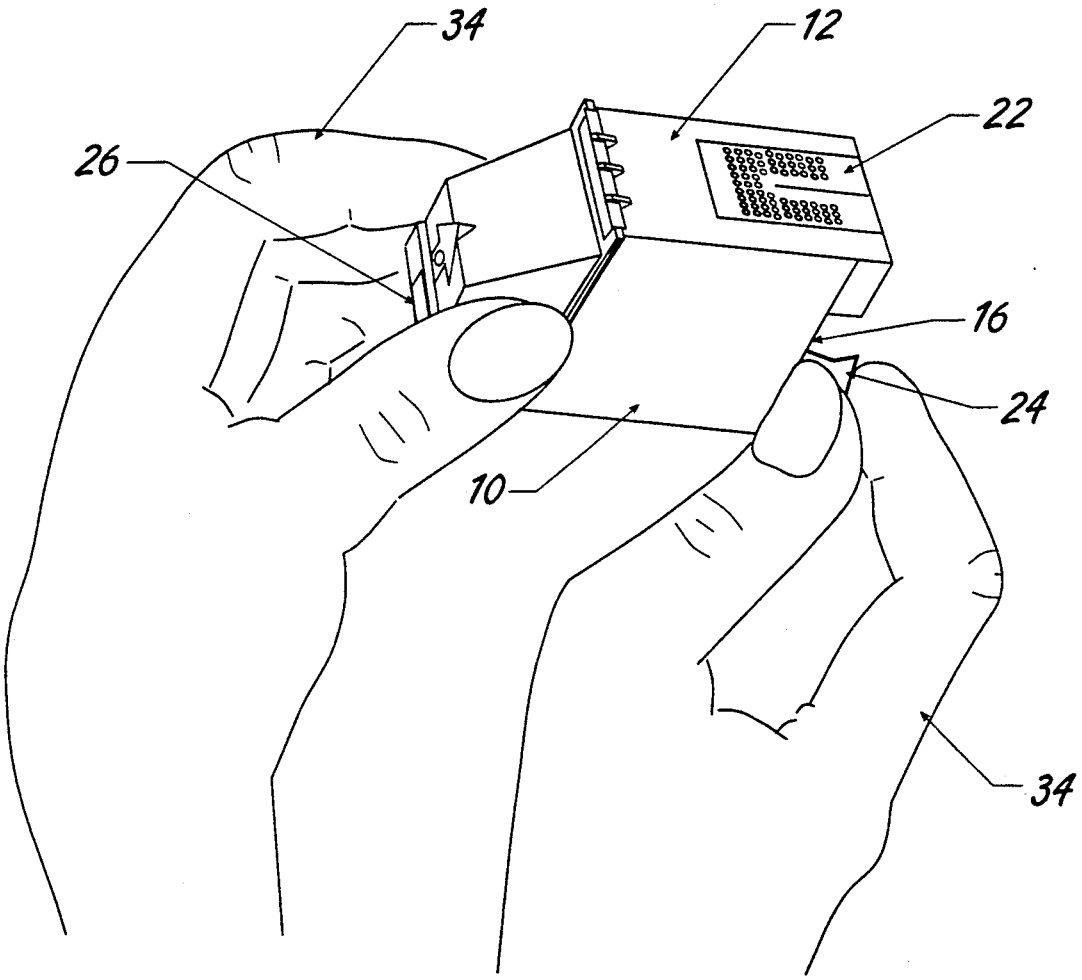
FIG. 6 illustrates removing sealing tape from the base of the ink refilled cartridge.
Figure 7:
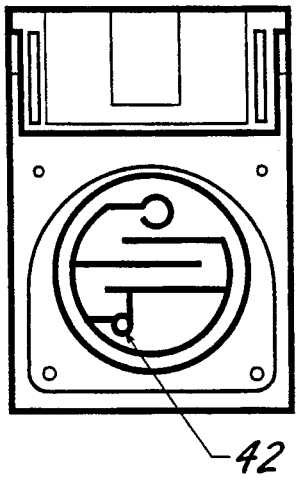
FIG. 7 illustrates the underside of the ink jet cartridge.

Finally pressure sensitive adhesive tape 24 (FIG. 6) is peeled away from the maze at the base of the cartridge 10 and vent hole 42 (FIG. 7). The cartridge may now be removed from clamp 30 on jig 28, and placed back into the printing device.

While the present invention has been disclosed in connection with the preferred embodiments shown and described in detail, various modifications and improvements thereon will become readily apparent to those skilled in the art. Accordingly, the spirit and scope of the present invention is to be limited only by the following claims.

What is claimed is:

1. A method for making a user refillable ink jet cartridge, said cartridge having a top portion and a base portion, said top portion having a first hole and a second hole, said first hole in said top portion being sealed in a first configuration with a plug, said base portion having a vent hole, said cartridge containing at least one bladder for being inflated with air to above atmospheric pressure, said bladder having an opening which is confluent with said second hole in said top portion, said method comprising the steps of:

sealing said vent hole in said base portion of said cartridge;

creating a second configuration for said first hole in said top portion of said cartridge by removing said plug and thereby unsealing said first hole; and, replenishing ink within said cartridge by injecting ink through said first hole which is now in said second, unsealed configuration due to the removal of said plug.

2. The method of claim 1, further comprising the step of placing an absorbent pad beneath said base portion of said cartridge.

3. The method according to claim 1, further comprising the step of inflating said bladder through said second hole in said top portion of said cartridge with said air to above said atmospheric pressure.

4. The method according to claim 3, further comprising the step of re-sealing said first hole in said second configuration of said first hole after said ink has been replenished within said cartridge.

5. The method according to claim 4 wherein the step of re-sealing said first hole occurs before the step of inflating said bladder with said air to above said atmospheric pressure.

6. The method according to claim 4 further comprising the step of unsealing said vent hole at said base portion of said cartridge.

7. The method according to claim 6 wherein the step of unsealing said vent hole occurs after said step of re-sealing said first hole in said second, unsealed configuration of said first hole.

8. The method according to claim 1 wherein the step of creating said second configuration for said first hole by removing said plug in said first hole in said first configuration comprises the step of pushing said plug into said cartridge.

9. The method according to claim 1, further comprising the step of securing said cartridge in a jig prior to said steps of sealing said vent hole, creating said second configuration in said first hole, and replenishing said ink within said cartridge.

10. The method according to claim 1 wherein said ink jet cartridge is a single color ink jet cartridge.

11. A user refillable ink jet cartridge assembly having a top portion and a base portion, said top portion having a first hole and a second hole, said first hole being sealed with a plug, said cartridge containing ink for dispensing ink in accordance with electronic commands, said cartridge additionally containing at least one bladder for being inflated with air to above atmospheric pressure, said bladder having an opening confluent with said second hole in said top portion, said base portion having a vent hole, said cartridge assembly including means for removing said plug from said first hole; means for replenishing said ink within said cartridge by injecting ink through said first hole after said plug has been removed; and means for sealing said vent hole, whereby when said injected ink is consumed during usage of said cartridge, said cartridge may be replenished with said injected ink through said first hole.

12. An ink jet cartridge assembly according to claim 11 wherein said means for sealing said vent hole includes pressure sensitive tape.

13. An ink jet cartridge according to claim 11 wherein said means for removing said plug include a cylindrically shaped rod for pushing said plug into said cartridge.

14. A user refillable ink jet cartridge assembly according to claim 13 wherein said first hole is re-sealed with pressure sensitive tape after said cartridge is filled with said injected ink, and then said bladder is inflated with said air to above said atmospheric pressure.

15. A user refillable ink jet cartridge assembly according to claim 14 wherein said bladder is deflated after said cartridge is filled with said injected ink, said first hole is re-sealed, and said bladder is inflated with said air.

16. A user refillable ink jet cartridge assembly according to claim 15 wherein said vent hole in said base portion of said cartridge is unsealed after said bladder is deflated.

17. An ink jet cartridge assembly according to claim 11 wherein said cartridge is filled with said injected ink through said first hole after said means for removing said plug from said first hole have removed said plug from said first hole.

18. A user refillable ink jet cartridge assembly according to claim 17, further comprising means for inflating said bladder with said air to said above atmospheric pressure through said second hole in said top portion of said cartridge.

19. A user refillable ink jet cartridge assembly according to claim 18 further including means for re-sealing said first hole after said cartridge is filled with said injected ink, and said bladder is inflated with said air to above said atmosphere pressure.

20. A user refillable ink jet cartridge assembly according to claim 19 wherein said bladder is deflated after said first hole is re-sealed.

21. A user refillable ink jet cartridge assembly according to claim 20 wherein said vent hole in said base portion of said cartridge is unsealed after said bladder is deflated.

22. A user refillable ink jet cartridge assembly according to claim 11 wherein said cartridge is secured in a jig.

23. An ink jet cartridge according to claim 22 wherein an absorbent pad is placed beneath said jig.

24. A kit for refilling an ink jet cartridge with ink, said cartridge having a top portion and a base portion, said top portion having a first hole and a second hole, said first hole being sealed with a plug, said base portion having a vent hole, said cartridge having an interior portion for holding ink and for retaining a bladder, said bladder for being inflated with air to above atmospheric pressure, said bladder having an opening confluent with said second hole in said top portion, said kit comprising:

means for unsealing said first hole;

a bottle of ink having means for connecting said bottle to said unsealed first hole and inserting said ink from said bottle into said interior of said cartridge;

means for inflating said bladder through said second hole whereby said bladder is caused to be inflated; and, means for sealing said vent hole in said base portion, and for re-sealing said first hole in said top portion after said plug has been removed.

* * * * *